United States Patent [19]

Frank et al.

[11] 4,428,552

[45] Jan. 31, 1984

[54] RAILROAD SWITCH MACHINE

[75] Inventors: Earl E. Frank, Tallman, N.Y.; Bing S. Yee, Paramus, N.J.

[73] Assignee: Abex Corporation, New York, N.Y.

[21] Appl. No.: 260,110

[22] Filed: May 4, 1981

[51] Int. Cl.[3] ..... B61L 7/04; B61L 5/04; F15B 11/10

[52] U.S. Cl. ..... 246/393; 246/258; 91/433; 200/153 LB

[58] Field of Search ..... 246/393, 395, 404, 405, 246/257, 258, 401, 402, 403, 406, 93, 100, 139, 140, 259, 277, 278, 279, 280, 394, 396, 399; 137/574; 74/568 R; 200/47, 153 LB; 91/461, 433

[56] References Cited

U.S. PATENT DOCUMENTS

| | | | |
|---|---|---|---|
| 1,162,693 | 11/1915 | Henry | 74/568 R |
| 1,893,246 | 1/1933 | Robertson et al. | 198/747 |
| 3,158,345 | 11/1964 | Wilhelm et al. | 246/258 |
| 3,270,582 | 9/1966 | Barth | 200/153 LB |
| 3,363,097 | 1/1968 | Wilhelm et al. | 246/393 |
| 3,427,448 | 2/1969 | Redelman | 246/393 |
| 3,483,344 | 12/1969 | Hermle | 200/153 LB |
| 3,642,086 | 2/1972 | Andrews | 137/574 |
| 4,036,106 | 7/1977 | Athy, Jr. | 91/433 |
| 4,213,588 | 7/1980 | Bowles | 246/258 |

*Primary Examiner*—David A. Scherbel
*Assistant Examiner*—Richard Mathieu
*Attorney, Agent, or Firm*—Kinzer, Plyer, Dorn & McEachran

[57] ABSTRACT

A high-speed switch machine for actuating railroad switch points. The machine has an electric motor which drives a hydraulic pump. The pump supplies pressure fluid to a hydraulic cylinder adapted to move the switch points from an initial to a second limit position. A four-way, two-position hydraulic control valve directs fluid to the cylinder such that the cylinder automatically operates in an extension and retraction cycle. The unidirectional motor and two-position control valve minimize response times of the actuating components so that the switch points are thrown in a short time period.

5 Claims, 7 Drawing Figures

RAILROAD SWITCH MACHINE

BACKGROUND OF THE INVENTION

This invention relates to machines for actuating railroad switches. Machines of this type are shown in U.S. Pat. Nos. 3,158,345 and 3,363,097. Generally, the actuating machines include an electric motor which drives a hydraulic pump. The pump supplies a hydraulic cylinder which is operatively connected to the railroad switch points. The switch machine of the present invention utilizes a rotary cam which is connected by a throw rod to the switch points. The cam is arranged to be rotated in opposite directions by successive extensions of the hydraulic piston rod. Thus, when the piston rod is extended it engages the rotary cam and causes the switch points to be thrown from an initial limit position to a second limit position. Then the piston rod is retracted, leaving the cam in a position where the next extension of the piston rod will cause the switch points to be moved from the second position back to the initial limit position. The rotary cam and its operation are described in U.S. Pat. Nos. 3,158,345 and 3,363,097.

Obviously, with the hydraulic cylinder and rotary cam arrangement described, some means must be provided for supplying hydraulic fluid such that the cylinder will go through its extension and retraction cycle. In U.S. Pat. No. 3,363,097 this is accomplished by providing a reversible electric motor and pump. The reversible motor eliminates the need for any hydraulic control valves but it has the disadvantage of requiring more complicated motor controls. Under U.S. Pat. No. 3,158,345 a three-position directional valve and an accumulator are utilized. The three-position valve has a center or neutral position where no fluid is supplied to the cylinder. It also has a left position wherein fluid is supplied to the piston side of the cylinder and a right position wherein fluid is supplied to the rod side of the cylinder. While both of these systems are operable, there is a certain amount of lost time involved in reversing the motor in the one case or shifting the positions of the directional valve, in the other case. The present invention is founded in a development which provides a high-speed switch machine which eliminates these time delays.

SUMMARY OF THE INVENTION

This invention relates to railroad switch machines and is particularly concerned with a machine having a faster actuating cycle.

One object of this invention is a high-speed switch machine which utilizes a uni-directional electric motor.

Another object is a high-speed switch machine which has a hydraulic cylinder controlled by a four-way, two-position hydraulic control valve.

Another object is a high-speed switch machine wherein hydraulic pressure fluid is supplied to a cylinder immediately when a pump is started so that no time is lost shifting a hydraulic valve spool.

Another object is a high-speed switch machine wherein the hydraulic pump and electric motor do not stop rotating or change direction of rotation during a complete throw cycle.

Another object is a railroad switch machine having an improved structure for adjusting the operation of electrical limit switches.

These and other objects are accomplished by a switch machine having a hydraulic pump powered by a uni-directional electric motor and supplying pressure fluid to a four-way, two-position hydraulic control valve. The hydraulic control valve supplies pressure fluid to a hydraulic cylinder as needed to move the switch points to a desired position.

DESCRIPTION OF A PREFERRED EMBODIMENT

Figure 1:
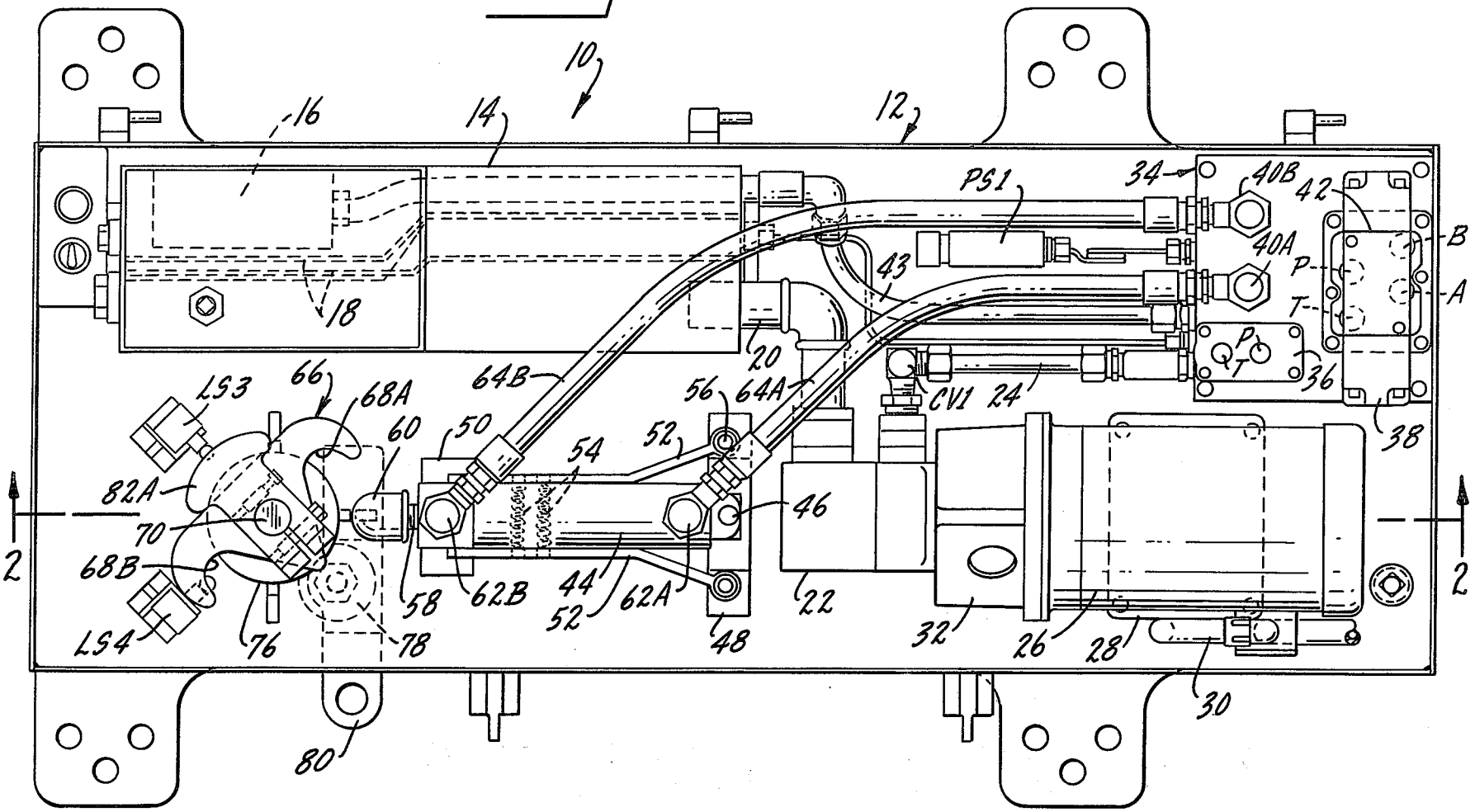
FIG. 1 is a plan view of a switch machine with the cover removed to show the internal components.
Figure 2:
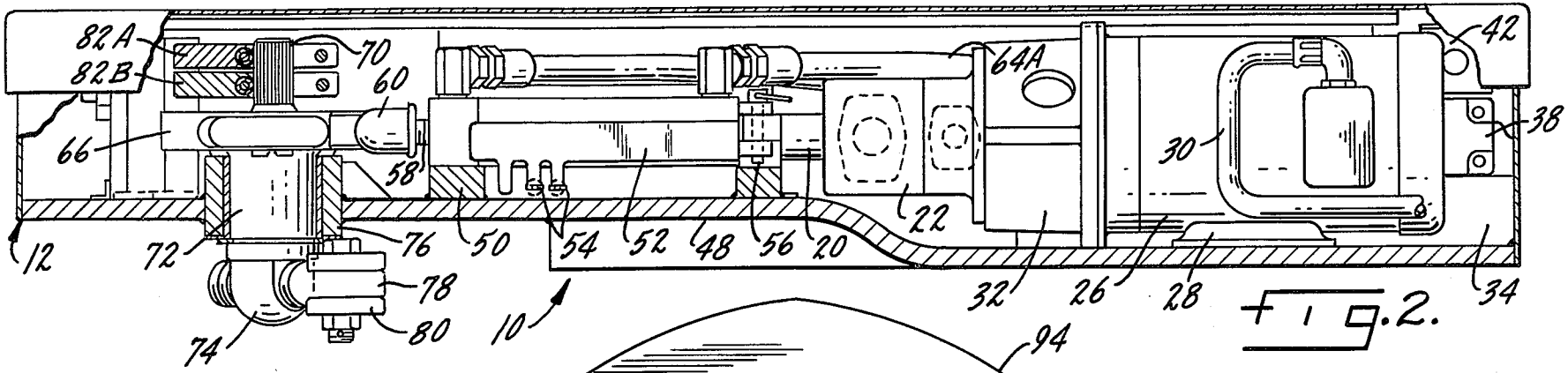
FIG. 2 is a section taken substantially along line 2—2 of FIG. 1.

A switch machine according to the present invention is shown generally at 10 in FIG. 1. The switch machine has a casing 12 including a base plate, side and end walls, and a hinged cover assembly (FIG. 2). The casing provides a weather and dust proof enclosure for the working components of the machine.

The railroad switch points (not shown) are thrown by a hydraulic apparatus including a power cylinder, a hydraulic control valve, a pump and electric motor and a hydraulic fluid reservoir. These components will now be described in detail.

A hydraulic fluid reservoir 14 includes a diffuser 16 in the fluid return line. One or more baffles 18 may be provided in the reservoir so as to provide a quiescent fluid supply at the pump inlet line 20. This helps prevent pump cavitation. A hydraulic pump 22 receives hydraulic fluid from the reservoir 14 through inlet line 20. High pressure fluid exits the pump to outlet line 24. An in-line check valve CV1 is placed in the outlet line 24.

The pump 22 is driven by a uni-directional electric motor 26 which is connected to the base plate by a suitable bracket 28. Electric power is supplied to the motor through a motor cable 30. The motor has an end bell 32 with appropriate openings therein for assisting in cooling the motor.

Pressure fluid from the pump, by way of outlet line 24, enters a manifold assembly 34. The manifold includes a pressure relief valve 36. The relief valve has connection points labeled P and T for internal connections of a pilot line and a drain line to the tank or reservoir 14. The manifold also includes a four-way, two-position hydraulic control valve 38. The control valve 38 has connection points, labeled P and T for the hydraulic pressure lines and for a drain line to the reservoir. The valve also has ports labeled A and B which connect to the swivel joints 40A and 40B. Located directly above the hydraulic control valve 38 is a directional valve 42. The directional valve is solenoid-operated and controls the position of the hydraulic valve 38.

A pair of pressure switches, one of which is visible at PS1, is connected to the manifold assembly 34. A fluid return line 43 provides fluid communication between the manifold 34 and the reservoir 14.

A hydraulic cylinder 44 is pivotally mounted at 46 to a mounting pad 48 which is in turn connected to the base plate of the casing 12. The end of the cylinder opposite the pivot point 46 slides on a pad 50. The cylinder 44 is centered by means of a pair of centering arms 52, which are interconnected by tension springs 54. The arms 52 are pivoted at 56 to the mounting pad 48. The hydraulic cylinder 44 includes an extendible piston rod 58 having a cam ball 60 secured to the outer end thereof. The cylinder 44 also has a pair of swivel joints 62A and 62B on the piston side and the rod side of the cylinder, respectively. Joint 62A is connected to swivel joint 40A on the manifold assembly by hydraulic pressure tube 64A. Similarly, swivel joints 62B and 40B are connected by the hydraulic pressure line 64B.

A turning cam 66 includes two cam pockets 68A and 68B, an upper, toothed spindle 70, a lower spindle 72 and a lower hub portion 74 (see FIG. 2). The lower spindle 72 is mounted in a journal 76 which in turn is formed in the base plate of the casing 12. The lower hub portion of the turning cam is connected by an eye bolt 78 to a connecting rod 80. The connecting rod is attached in a suitable manner to the throw rod (not shown).

Figure 3:
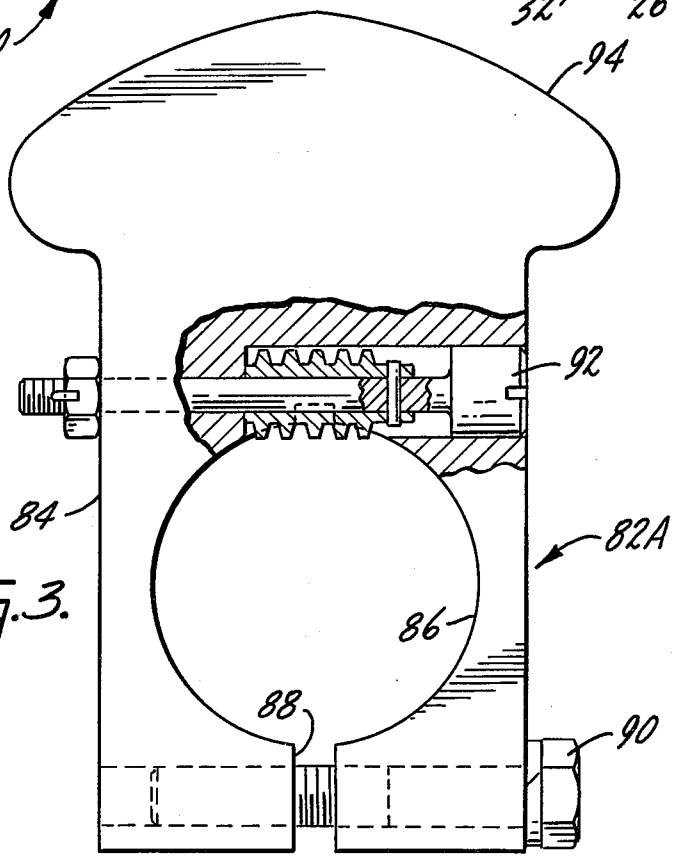
FIG. 3 is a plan view of a position cam.

Two position-indicating cams 82A and 82B are mounted on the upper spindle 70. The cams are positioned to actuate limit switches LS3 and LS4. The cams actuate a limit switch when the railroad switch points have reached one of the limit positions. Details of the construction of cam 82A are shown in FIG. 3; cam 82B has the same construction. The cam includes a body 84 having a central bore 86. An opening 88 is cut at the end of the body portion with a tightening bolt 90 extending through the separate legs formed by the opening. A worm gear assembly 92 is provided with the worm teeth projecting into the bore 86. The teeth engage those of the upper spindle 70 on the turning cam. With this arrangement the position of the cam surface 94 can be accurately controlled. The orientation of the cam on the spindle can be adjusted by the worm 92. When the proper location is attained the bolt 90 is tightened to maintain the cam in the proper location. This structure eliminates the need for an adjustable limit switch arm, as the adjustment is now provided in the cam mounting.

The operation of the the turning cam is fully described in the patents referred to above. To summarize that operation briefly, the following actions take place in throwing the switch points from an initial limit position to a second limit position. Fluid pressure is supplied to the piston side of the cylinder 44 causing the piston rod 58 to extend. The cam ball 60 engages the turning cam 66, causing the cylinder to pivot until the cam ball engages pocket 68A. Continued extension of the piston rod causes the counter clockwise rotation (as seen in FIG. 1) of the turning cam. When the railroad switch points arrive at the second limit position the hydraulic fluid supply is reversed so that it is connected to the rod side of the cylinder. This causes the piston rod to retract. The centering arms 52 return the cylinder to its original position. At this point the turning cam has been rotated such that upon a subsequent extension of the piston rod, the cam ball will engage pocket 68B, and thereby throw the switch points back to the initial limit position.

Figure 4:
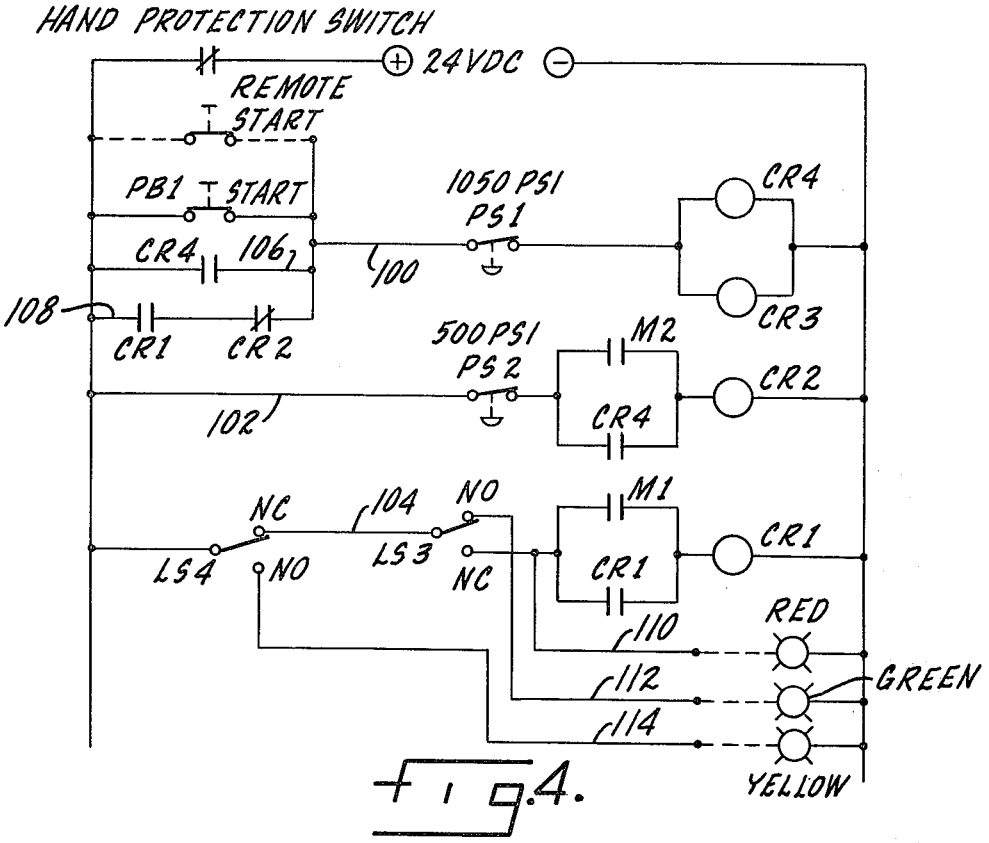
FIG. 4 is a schematic diagram of the electrical control circuit for the switch machine.

The electrical and hydraulic circuits which control the operation of the switch machine are illustrated in FIGS. 4–7. In FIG. 4 a 24-volt DC power supply is applied to the ladder network as shown. A hand protection switch contact is provided. These contacts are opened when a control relay activated by the manual switch stand at a switch machine is activated. This is to prevent injury caused by an inadvertent automatic switch operation during an attempted manual throw of a switch.

The ladder network includes three main lines 100, 102 and 104. Line 100 includes a pressure switch PS1 and parallel-connected control relays CR3 and CR4. Line 100 also includes a push button start switch PB1. There may also be a remote start switch as shown in phantom. A holding circuit 106 includes normally open contacts CR4. A second holding circuit 108 has normally open contact CR1 and normally closed contact CR2.

Line 102 includes a control relay CR2, parallel-connected contacts M2 and CR4 and a pressure switch PS2.

Line 104 includes a normally open limit switch LS3 and the normally closed limit switch LS4. Line 104 also has parallel-connected contacts CR1 and M1 and a control relay CR1. Red, green and yellow indicator lights are connected to line 104 as shown. These indicator lights may be at a remote location, such as a railroad control tower. The red light is energized through line 110, the green light through line 112 and the yellow light through line 114.

Figure 6:
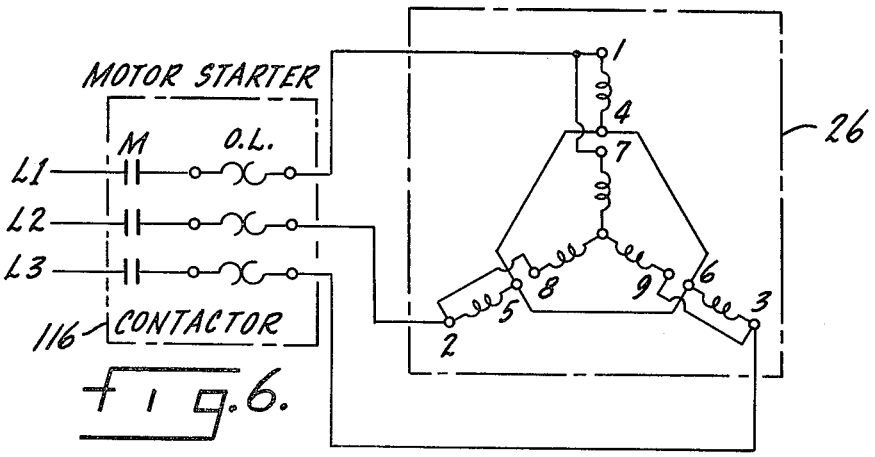
FIG. 6 is a schematic diagram of the motor control portion of the electric circuit.

The motor and motor starter circuits are shown in FIG. 6. The motor is shown for 220 volt operation on three-phase, 60 Hertz power. The motor 26 may be a three horsepower motor operating in a range of 1425–1725 rpm. The motor starter includes a contactor 116 having overload protection devices labeled OL and motor contacts M. The power is supplied on lines L1, L2 and L3.

Figure 5:
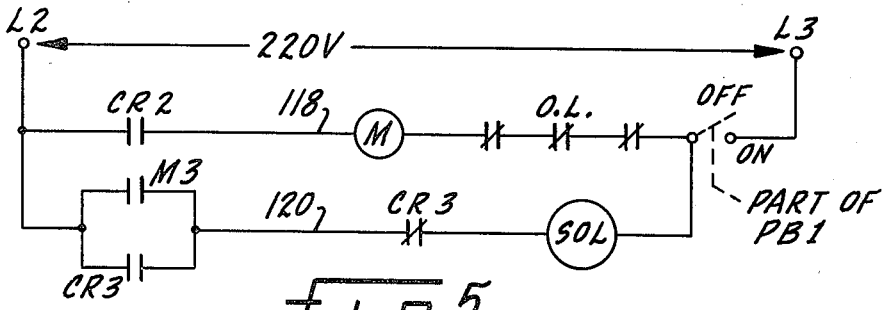
FIG. 5 is a schematic diagram of another portion of the electrical control circuit.

The motor control circuit is shown in FIG. 5. 220-volt, 60 Hz power is supplied across points L2 and L3. Line 118 includes a motor control relay M, overload protection contacts OL and contacts CR2. Line 120 has parallel-connected contacts, M3 and CR3 in series with normally closed contact CR3 and a solenoid SOL. Both lines 118 and 120 are connected to point L3 by an on-off switch which is part of push button switch PB1.

Figure 7:
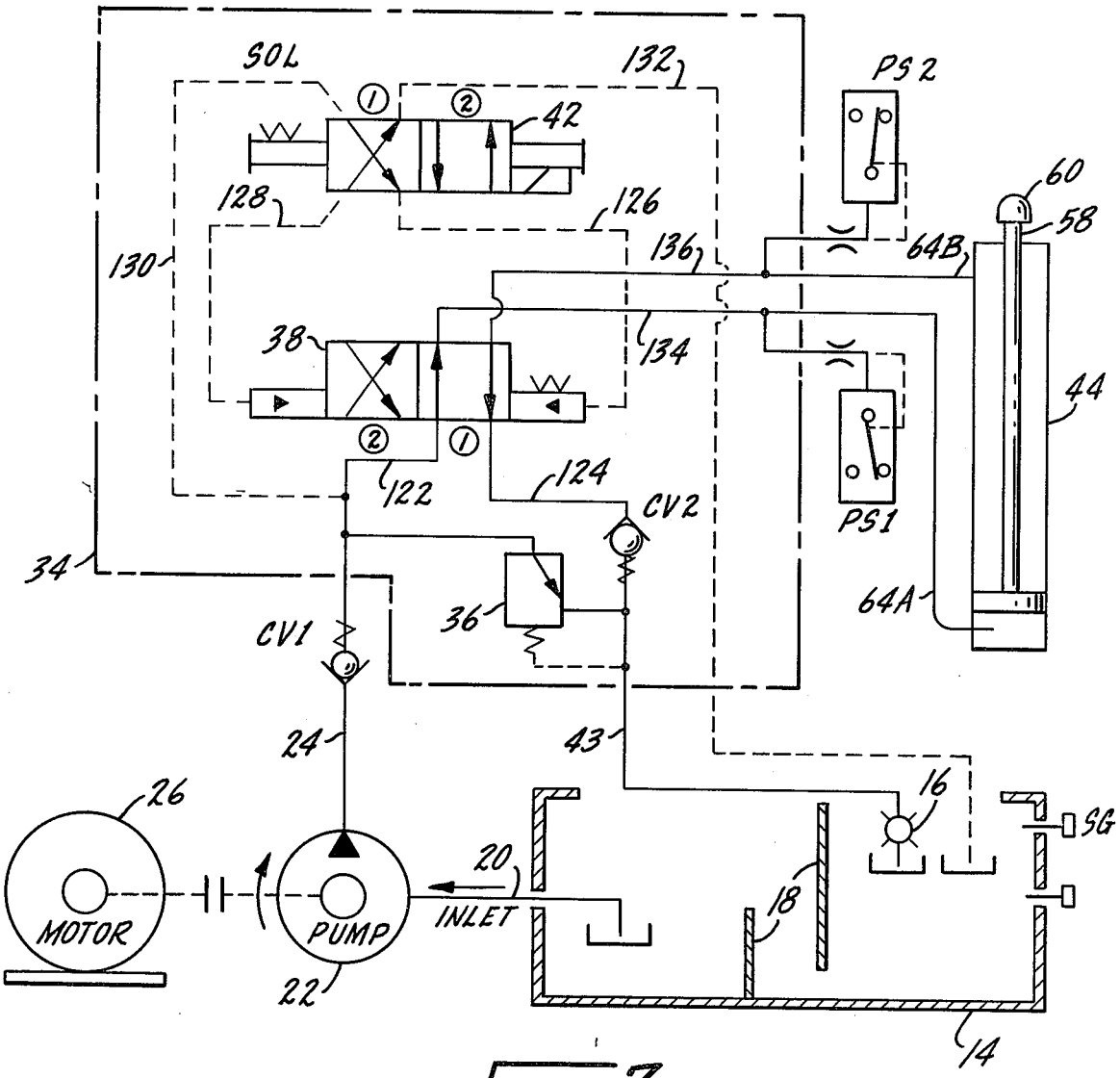
FIG. 7 is a schematic diagram of the hydraulic control circuit.

The hydraulic circuit is shown in FIG. 7. This is a diagrammatic representation of the parts previously shown and described in connection with FIGS. 1 and 2. Common reference numerals are used for the same parts. The internal connections of the manifold 34 include a hydraulic pressure line 122 supplying pressure fluid from the pump outlet line 24 to the hydraulic control valve 38. A drain line 124, including a check valve CV2, connects the control valve 38 to the reservoir return line 43. Relief valve 36 is provided between lines 122 and 124 to prevent damage to the system in the event of a malfunction.

Hydraulic control valve 38 is a four-way, two-position valve. The normal working position labeled 1 is shown in FIG. 7. The reverse position is labeled 2. The valve 38 is shifted between positions 1 and 2 by pilot pressure in lines 126 and 128. Pressure in these lines is in turn controlled by the directional valve 42. The directional valve is shown in its normal working position 1 and is movable to reverse position 2 by solenoid SOL. Pilot pressure is supplied through line 130 from pressure line 122. A tank or drain line 132 connects the outlet of directional valve 42 to the reservoir 14. The hydraulic valve 38 is connected by pressure lines 134 and 136 to the cylinder tubes 64A and 64B. Pressure switches PS1 and PS2 are in communication with lines 134 and 136, respectively.

The operation of the switch machine is as follows:

The drawings show the switch machine and control circuits in their normal working positions. In this state the railroad switch points are in the straight through position, limit switch LS3 is normally open and limit switch LS4 is normally closed. The motor 26 is off and pressure switches PS1 and PS2 are closed. The green indicator light is lit through lines 104 and 112.

It will be noted that in the state described, everything is in readiness for the next throw of the switch points. The hydraulic control valve 38 in position 1 will immediately supply pressure fluid through lines 134 and 64A to the piston side of cylinder 44. No shifting of valve spools or other time consuming operations are necessary to prepare the switch machine for a throw. This increases the speed of the switch machine, thereby decreasing the time needed for a throw.

A switch throw is initiated by pushing the start button PB1 (or the remote start button). This connects the 220-volt source across points L2 and L3 in FIG. 5 and also energizes control relays CR3 and CR4. Contacts CR4 in line 106 close to maintain the circuit through line 100. Contacts CR4 in line 102 also close causing the energization of control relay CR2. As a result of the energization of relay CR3, the contacts CR3 in line 120 (FIG. 5) close and open, respectively. When relay CR2 is energized through line 102 and contact CR4, the normally-closed contacts CR2 in holding circuit 108 open and the contacts in line 118 close. This latter action energizes relay M, closing contacts M (FIG. 6) which starts the motor 26. Simultaneously, the contacts M1, M2 and M3 close in lines 104, 102 and 120 respectively. When the motor starts hydraulic pressure fluid is applied to the piston side of cylinder 44 through hydraulic lines 24, 122, control valve 38 in position 1 and lines 134 and 64A. Thus, the piston and rod extend from the cylinder, bringing about the rotation of the turning cam 66 as described above. The operation of the control circuit to this point can be labeled the extending sequence.

As the turning cam 66 begins to rotate, the position cam 82A slides off the limit switch LS3, thereby altering the condition of LS3 to a closed position. As seen in FIG. 4, this disconnects the green indicator light and lights the red indicator light through line 110. The red indicator informs control personnel that the railroad switch is in an open position. The closing of LS3 also energizes relay CR1 through line 104 and contacts M1. This closes contacts CR1 both in line 104 and the holding circuit 108. When the railroad switch points safely reach the turn out position, cam 82B actuates LS4 to an open position. This deenergizes relay CR1, reopening contact CR1 in line 104 and the holding circuit 108. Also the changed position of LS4 turns off the red indicator light and turns on the yellow indicator light through line 114. The yellow light informs personnel that the switch points are in the turn out position.

At this time the following actions, which may be referred to as the retraction sequence, take place. When the railroad switch points reach the second limit position cam 66 is restrained from further rotation. Thus, the piston rod 58 is also prevented from any further extension. This causes a build up of pressure in lines 64A and 134. When the pressure reaches a set limit, pressure switch PS1 opens, breaking the circuit in line 100 and deenergizing relays CR3 and CR4. This causes the following events. Contacts CR4 in holding circuit 106 open so that, together with the previous opening of contact CR1, line 100 will not be energized until the subsequent actuation of the push button switch. Also the contacts CR4 in line 102 open but relay CR2 remains energized through PS2 and M2. The deenergization of CR3 causes the contacts CR3 to open and close respectively, in line 120. Since contacts M3 are closed at this time, the solenoid SOL is activated through line 120. The solenoid reverses the position of the directional valve 42 (FIG. 7), reversing it from position 1 to position 2. This causes pressure fluid in pilot line 130 to be directed into line 128. Line 126 is then connected to the drain line 132. This reversal of the pilot pressure causes the main hydraulic control valve 38 to shift from position 1 to position 2. When the main valve 38 reverses pressure is supplied to the rod side of cylinder 44 through lines 122, 136 and 64B. Also at the same time the pressure in lines 64A and 134 is relieved through the drain line 124. This causes the pressure switch PS1 to reclose. However because both holding circuits 106 and 108 are open at this point the extension sequence does not recur.

When the piston and rod reach the full retract position pressure begins to build in lines 64B and 136. When the pressure reaches a preset limit the pressure switch PS2 opens. This breaks the circuit through line 102 (FIG. 4) causing relay CR2 to be deenergized. Contacts CR2 in holding circuit 108 close while CR2 contacts in line 118 open. This latter action deenergizes relay M, opening contacts M in the motor starter 116 (FIG. 6). Thus, the motor 26 is shut off. Also contacts M3 in line 120 open resulting in the deenergization of solenoid SOL. This in turn returns the directional valve 42 to position 1, relieving the pilot pressure in line 128 and returning it instead to line 126. The pilot pressure in line 126 returns the hydraulic control valve to position 1. When position 1 of the main valve is reached line 136 is relieved through drain line 124 which results in the closure of pressure switch PS2.

The switch machine is now conditioned for a throw from the turn out position to the straight through position. This is accomplished with basically the same extension and retraction sequence described above with the exception that the limit switch LS4 is first to be reversed from an open to a closed position (thereby turning off the yellow light and turning the red light on) and then limit switch LS3 is thrown from a closed to an open position when the straight through location is obtained (and similarly the red light goes off and the green light comes on).

If an obstruction is encountered by the switch points during a throw, recycling means in the control circuit automatically return the switch points to the initial limit position. This is accomplished in the following manner. A normal extension sequence is performed but the second limit position is never reached due to the obstruction. Thus in the case of a straight through to turn out throw which is obstructed, the limit switch LS3 closes but the limit switch LS4 is never opened. Thus, the red indicator light remains on, the relay CR1 remains energized through line 104 and the contacts CR1 in holding circuit 108 remain closed. The obstruction in the switch points causes the build up of pressure on the piston side of cylinder 44, resulting in the opening of pressure switch PS1. The retraction sequence then takes place as described above. When full retraction of the piston is obtained, pressure builds in lines 64B and 136. This opens pressure switch PS2 as in the normal retraction sequence. However, the deenergization of CR2 upon opening of PS2, completes the holding circuit 108. Thus, as soon as PS2 recloses a second extension sequence is initiated through holding circuit 108 and line 100. This second extension causes the turning cam 66 to be moved back to its initial position. In the case under consideration this will result in limit switch LS3 being opened, turning off the red and turning on the green light. A normal retraction sequence then takes place. The attempt to throw the switch to the turn out position has failed but the switch points are not left in an open condition.

We claim:

1. In a high-speed railroad switch machine for throwing switch points between initial and second limit positions, a uni-directional electric motor, a hydraulic pump driven by the motor, a hydraulic cylinder including a piston, a four-way, two-position hydraulic control valve adapted to supply hydraulic fluid to the cylinder such that the piston is alternately driven in extending and retracting directions, rotary cam means engageable by said piston and adapted to be turned in opposite directions by successive extension strokes of the piston, connecting means operatively connecting the cam means to the switch points to move the switch points between either limit position upon a predetermined amount of rotation of the cam means in one direction or the other, control means for the motor and hydraulic control valve including detecting means to detect arrival of the switch points at the second position during a throw and effective thereupon to reverse the hydraulic control valve to cause retraction of the piston thereby conditioning the piston for the next extension stroke thereof which will reverse the switch points from the second to the initial limit position, said control means then reversing the hydraulic control valve again to recondition it for a subsequent extension of the piston immediately upon the restarting of the hydraulic pump.

2. The structure of claim 1 further characterized in that the detecting means is also effective to reverse the hydraulic control valve to cause retraction of the piston in the event the switch points encounter an obstruction and fail to reach the second limit position during an attempted throw of the switch points, the control means further including recycling means to cause a second cycle of the cylinder when an obstruction is encountered, to thereby produce re-extension of the piston and return of the switch points to the initial limit position when there is a failure to reach the second limit position because of an obstruction.

3. The structure of claim 1 further characterized in that the hydraulic control valve is actuated by fluid pressure supplied by the pump through a pilot line and a directional control valve.

4. The structure of claim 1 wherein the detecting means includes at least one limit switch and a position cam associated with the limit switch so as to actuate the limit switch when the switch points are at one of the limit positions, the position cam being adjustably mounted on the rotary cam so that the position cam can be precisely located to ensure that its actuation of the limit switch coincides with the arrival or departure of the switch points at a limit position.

5. A high-speed railroad switch machine for throwing switch points between first and second limit positions, comprising:

a uni-directional electric motor;

a hydraulic pump driven by the motor;

a hydraulic cylinder including a piston operatively connected to the switch points;

a four-way, two-position hydraulic control valve adapted to supply hydraulic fluid to the cylinder such that the piston is alternately driven in extending and retracting directions by fluid from the pump;

electrical control circuitry for governing operation of the motor; and means for positioning the hydraulic control valve so as to cause the cylinder to throw the switch points to a desired limit position, said means repositioning the hydraulic control valve after an extension and retraction such that the hydraulic control valve supplies fluid for an extension sequence immediately upon a subsequent start-up of the pump.

* * * * *